United States Patent [19]

Roddy

[11] 4,340,109

[45] Jul. 20, 1982

[54] PROCESS OF DIE CASTING WITH A PARTICULATE INERT FILLER UNIFORMLY DISPERSED THROUGH THE CASTING

[75] Inventor: Joseph T. Roddy, St. Louis, Mo.

[73] Assignee: Emerson Electric Co., St. Louis, Mo.

[21] Appl. No.: 124,293

[22] Filed: Feb. 25, 1980

[51] Int. Cl.[3] ..... B22D 19/00

[52] U.S. Cl. ..... 164/97; 164/113; 164/103; 164/900

[58] Field of Search ..... 164/97, 71, 113, 120, 164/55, 312, 339, 342, 80

[56] References Cited

U.S. PATENT DOCUMENTS

| | | | |
|---|---|---|---|
| 2,793,949 | 5/1957 | Imich | 75/135 |
| 3,028,644 | 4/1962 | Waldrod | 164/97 |
| 3,147,087 | 9/1964 | Eisenlohr | 75/234 |
| 3,239,319 | 3/1966 | Pollard | 428/580 |
| 3,349,833 | 10/1967 | Hodler | 164/113 |
| 3,791,438 | 2/1974 | Ikeda et al. | 164/97 |
| 3,894,575 | 7/1975 | Baum | 164/97 |
| 4,034,464 | 7/1977 | Hetke | 29/527.6 |
| 4,108,643 | 8/1978 | Flemings et al. | 75/135 |

FOREIGN PATENT DOCUMENTS

| | | | |
|---|---|---|---|
| 51-19808 | 6/1976 | Japan | 164/97 |

*Primary Examiner*—R. L. Spruill
*Assistant Examiner*—K. Y. Lin
*Attorney, Agent, or Firm*—Polster, Polster and Lucchesi

[57] ABSTRACT

Apparatus for and method of die casting a part with a particulate inert filler material (e.g., sand) substantially uniformly dispersed through the casting thereby to decrease the amount of metal required to die cast the part.

11 Claims, 5 Drawing Figures

FIG. 1.
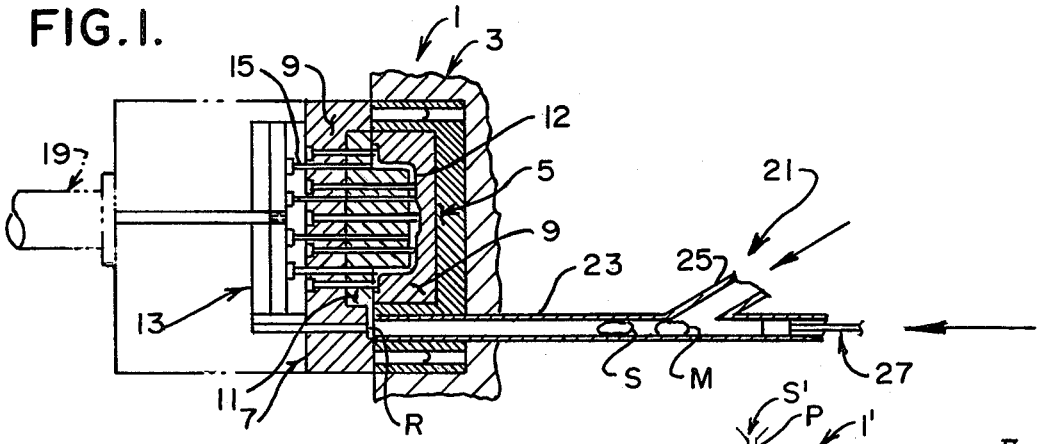
FIG. 2.
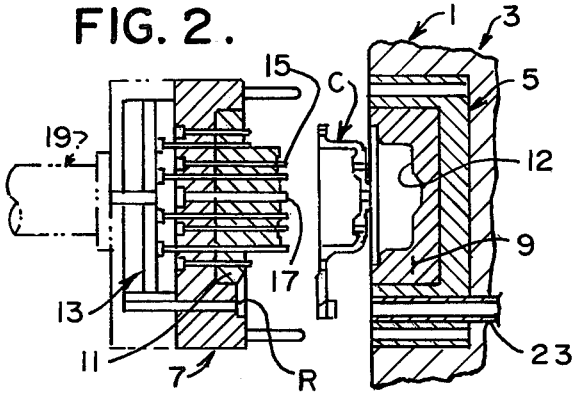
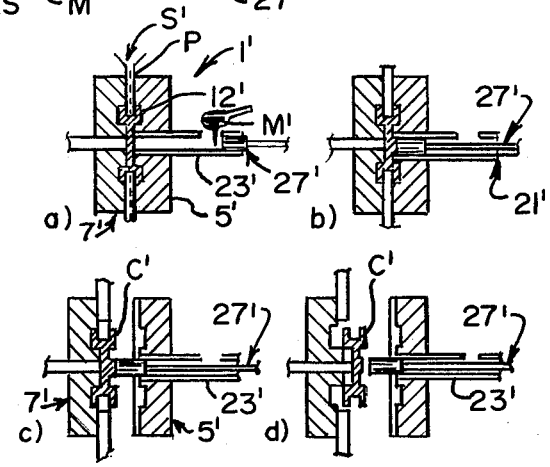
FIG. 3.
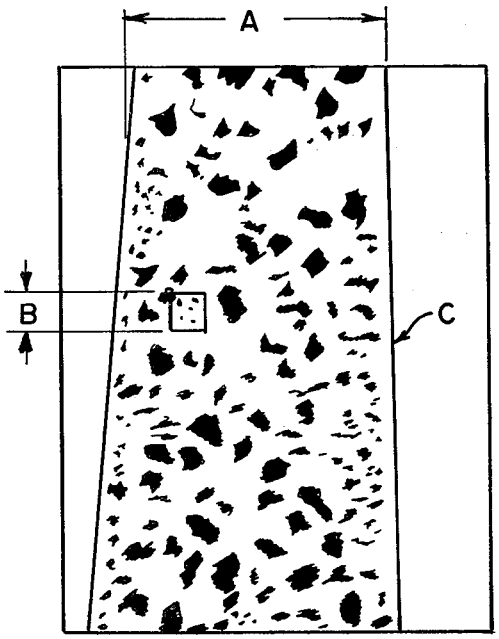
10 X
FIG. 4.
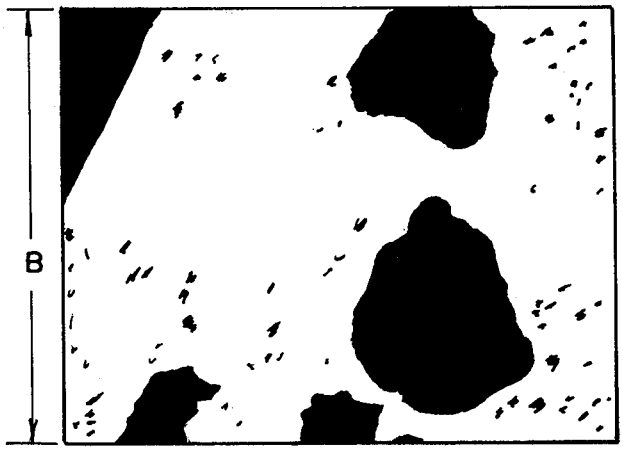
50 X
FIG. 5.

PROCESS OF DIE CASTING WITH A PARTICULATE INERT FILLER UNIFORMLY DISPERSED THROUGH THE CASTING

BACKGROUND OF THE INVENTION

This invention relates to apparatus for and a process of die casting a metal part in which a particulate inert filler material is intermixed with the molten metal thereby to form a casting having the inert filler material substantially uniformly distributed throughout the casting so as to reduce the amount of metal required to make the casting.

In the die casting of many parts, for example, in the die casting of end shields for electric motors or the like, certain portions of the casting are required to be of a minimum thickness solely to facilitate die casting of the part. Oftentimes, this minimum thickness is greater than is required for purposes of strength. Thus, many die castings are excessively costly and result in the "wasting" of expensive materials in that these materials are not efficiently used. Through trial and error experience, it has been found that in order to produce a satisfactory die casting, a minimum thicknesses of various sections of the casting must be maintained in order to result in satisfactory castings.

Reference may be made to U.S. Pat. Nos. 2,793,949, 3,147,087 and 3,239,319 which relate broadly to the same general field as the process and apparatus of the present invention. Specifically, U.S. Pat. No. 2,793,949 discloses utilizing a wetting agent to overcome the surface tension of molten metal thereby to permit mixing of the molten metal with particles of an inorganic, non-metallic material. U.S. Pat. No. 3,147,087 discloses the provision of an abradable material consisting of graphite or graphite and mica particles disposed in an aluminum matrix in the proportion of about 2.5–10% by weight. U.S. Pat. No. 3,239,319 discloses a process of filling a mold cavity with a particulate, non-metallic, inorganic material, and applying a vacuum to the mold cavity so as to draw molten metal into the cavity and to completely fill the voids between the particles.

Among the several objects and features of the present invention may be noted the provision of apparatus for and a process of die casting metal parts in which the amount of metal required for the die casting is substantially reduced (e.g., up to sixty percent of the amount of metal used in the casting may be saved) and yet which results in a casting of adequate strength and satisfactory appearance;

- the provision of such a die casting process and apparatus which utilizes an inert particulate filler material which is uniformly mixed with the die cast metal so as to form a die cast part having the inert filler materials substantially uniformly distributed throughout the part;
- the provision of such a die casting process and apparatus which may be utilized without substantial modifications to conventional die casting manufacturing processes and equipment;
- the provision of such a die casting process and apparatus which may be cycled at acceptable production rates;
- the provision of such a process and method which, in one embodiment thereof, may be used to die cast the part without the premixing of the inert particulate filler material and the molten metal;

- the provision of such a die casting process and apparatus which, in another embodiment thereof, utilizes a premixed inert particulate filler material and molten metal to die cast a part with the particulate filler material substantially uniformly distributed throughout the die cast part;
- the provision of such a die casting process and apparatus which when used to fabricate a die cast end shield of an electric motor, results in reduced noise of the motor because the resulting die cast end shield has less of a tendency to transmit sound therethrough; and
- the provision of such a process and apparatus which results in reduced material costs, and yet which maintains or may even improve the strength of the part.

Other objects and features of this invention will be in part apparent and in part pointed out hereinafter.

SUMMARY OF THE INVENTION

Briefly stated, this invention relates to a process of die casting a part from a metal alloy with an inert, particulate, filler material substantially uniformly distributed throughout the cast part thereby to decrease the amount of metal alloy required to form the part. The process consists of the steps of preheating the inert filler material to a temperature sufficient to at least partially prevent the premature solidification of the molten metal alloy on the filler. Then, a predetermined amount of the preheated filler material is placed in the ram of a die casting machine or apparatus. A predetermined quantity of molten metal alloy is also placed in the ram, and the filler and the molten metal are then together injected into the die of the die casting machine with the molten metal being substantially uniformly mixed with the inert filler material as the molten metal flows into the die so as to form the part.

Alternatively, the process of this invention of die casting a part with an inert, particulate filler material dispersed substantially uniformly through the part may involve first filling a die cavity with the particulate filler material with the filler material having interstices or spaces therebetween. Then, molten metal is injected under pressure into the die cavity whereby the molten metal flows into the interstices so as to surround the filler particles and solidifies to form the part.

Still further, this invention contemplates apparatus for die casting a part of a suitable metal alloy having an inert particulate filler material dispersed substantially uniformly therethrough, the apparatus comprising a frame, a die including a stationary die part and a movable die part with the die parts being cooperable with one another so as to form a mold or die cavity for the part to be cast. The movable die part is movable to an open position thereby to enable removal of the die cast part and the apparatus further includes means for ejecting the die cast part from the stationary die part. The apparatus still further includes means for injecting under pressure a predetermined amount of molten metal into the die cavity and means for mixing a predetermined amount of inert particulate material with the molten metal as the latter is injected into the die cavity.

BRIEF DESCRIPTION OF THE DRAWINGS

FIG. 1 is a diagrammatic view of a conventional die casting machine modified in accordance with this invention for carrying out the method of this invention of die casting a part (e.g., an end shield for an electric motor or the like) with the part having a particulate inert filler material substantially uniformly distributed throughout the part, the machine being illustrated in its closed position;

FIG. 2 is view similar to FIG. 1 illustrating the die casting machine in its open position for removal of a die cast part therefrom;

FIGS. *3a–3d* illustrate the various steps in carrying out one embodiment of the process or method of the present invention;

FIG. 4 is a drawing of a photomicrograph (10X) of a cross section of a relatively thin web of a part die cast in accordance with the process of this invention illustrating inert filler material particles distributed substantially uniformly through the part and further illustrating the provision of a thin skin of substantially virgin metal (i.e., metal with little or no filler particles therein) at the outer surfaces of the part thereby to provide a pleasing appearance and surface finish for the part; and FIG. 5 is a greatly enlarged (50X) view of a portion of the specimen shown in the box in FIG. 4 illustrating that the individual particles of the inert filler material are completely surrounded by the metal alloy substantially without the formation of voids or bubbles.

Corresponding reference characters indicate corresponding parts throughout the several views of the drawings.

DESCRIPTION OF PREFERRED EMBODIMENTS

Referring now to FIGS. 1 and 2 of the drawings, die casting apparatus of the present invention is indicated generally by reference character 1. This die casting apparatus is shown to comprise a frame 3 (only a portion of which is illutrated) in which are mounted a stationary die 5 and a movable die 7. Each of the dies respectively includes impression blocks 9 and 11 which cooperate with one another when the die parts are closed so as to form a mold cavity 12 in which may be molded a desired die cast part C. As is conventional, the stationary die includes an ejector mechanism 13 including a plurality of ejector pins 15 for ejecting a die cast part from the dies when the dies are open as illustrated in FIG. 2. Further, movable die 7 may include core pins 17 for forming desired openings or bores in the die cast part. A hydraulic cylinder arrangement (not shown) may be provided for moving movable die 7 between a closed position (as shown in FIG. 1) and an open position (as shown in FIG. 2) for permitting removal of the die cast part C. As is conventional, when the dies are closed, the dies are sealed relative to one another thus permitting molten metal to be injected into die cavity 12 under pressure and so as to mold the desired part. It will further be understood, as is well known in the art, that various venting ports and runners may be provided within the dies as is necessary for satisfactory die casting. A hydraulic cylinder unit 19 is provided for actuating ejector mechanism 13.

Apparatus 1 further includes means, as generally indicated at 21, for the in-feed of a molten metal alloy from which die cast part C is to be cast. As shown in FIG. 1, this molten metal in-feed system comprises a shot sleeve 23 having a ladle port 25 therein through which a premeasured charge of molten metal may be placed in the shot sleeve, and a runner R interconnecting shot sleeve 23 and die cavity 12. As is conventional, a ram 27 powdered by a suitable hydraulic cylinder unit or the like (not shown) is reciprocable within the bore of the shot sleeve so as to inject the molten metal into die cavity 12 under extreme pressure thereby to force the molten metal into all spaces of the die cavity so as to satisfactorily mold the part.

Specifically, the process or method of this invention relates to the production of a die cast part C which is characterized by a cast metal matrix having uniformly distributed therein a particulate inert filler material. The purpose of the filler material is to occupy volume in the cast part thereby to decrease the amount of metal required to cast the part and thus to correspondingly reduce the cost of the casting. This, of course, presumes that the particulate filler material is substantially less in cost than the metal.

Turning now to a detailed disclosure of the method or process of the present invention, any particulate, inert material which does not react chemically with the metal matrix of the casting, which is not affected by the heat of the molten metal, and which is incompressible may be utilized as a filler material. Preferably, the filler material should be of relatively low cost so as to maximize the cost savings aspect of utilizing filler material, and further it is preferred that the filler material be of sufficient strength so as to carry at least part of the load of the casting in much the same way as aggregate in concrete tends to increase at least somewhat the load carrying capability of the cement. For example, the particulate inert filler material preferred in this invention may be silica sand or glass beads with the silica sand, of course, being much less expensive. Even more preferably, in accordance with this invention, it has been found desirable that river sand having rounded sand grains is preferable to other types of sand which may have sharp or irregular edges. However, it is to be understood that, within the broader aspects of this invention, it is not necessary (but only preferable) to utilize the rounded sand grains.

Still further in accordance with this invention, it has been found that the maximum grain size of the sand (i.e., the average diameter of the sand grains) should not exceed about one third of the minimum thickness of the cast part C to be formed. By ensuring that the sand grains are less than about one third of the minimum casting thickness, the tendency of the sand to block the flow of the molten metal and the sand grains through the various passages and narrow clearances of the dies is greatly reduced. Still further resulting from this desired grain size, it is ensured that the molten metal will substantially surround all portions of the grains of sand thus providing a continuous and redundant load path for carrying the load of the casting. Even more specifically, it has been found desirable that the grain size of the sand should range between about 0.020–0.030 inches (0.5 and 0.76 mm.).

Referring now to FIG. 1, a first embodiment of the method or process of this invention will now be discussed. In accordance with this first embodiment of the process, a premeasured quantity of inert filler material S (e.g., sand) is ladled or placed in shot sleeve 21 via ladle port 25. In accordance with this invention, it is preferable that the charge of sand is preheated to an elevated temperature, preferably to a temperature approximately equal to the melting point of the metal alloy from which casting C is to be formed. For example, in casting a part C of an aluminum alloy having a melting temperature of approximately 1100° F. (593° C.), the charge of filler material or sand is also preferably preheated to approximately 1100° F. (593°) plus or minus 250° F. (138° C.).

By preheating the filler material, it is ensured that the molten metal will not become instantaneously chilled upon contacting the filler and thus prevent the flow of the molten metal in the die cavity to form casting C. Further, by heating the filler material, it is insured that all extra moisture is removed from the sand which may flash to steam upon contact with the molten metal with the shot sleeve or mold.

Further in accordance with this invention, a premeasured charge of molten metal alloy M (e.g., a specified aluminum alloy) is ladled into ladle port 25. As the molten metal enters shot sleeve 23, the heated filler material will float on the molten metal and the latter will flow under the filler material so that the molten metal and the filler material both extend lengthwise within the shot sleeve thereby to facilitate intermixing of the filler material and the molten metal. Then, ram 27 is actuated so as to drive the charge of molten metal M and the premeasured charge of sand S disposed in the shot sleeve into the die cavity 12. As the ram applies pressure to the molten metal, the molten metal and the filler material are caused to intermix. This mixture is then forced under pressure into die cavity 12 of the die casting machine so as to form a metal matrix having the particulate filler material distributed substantially uniformly therethrough. It will thus be appreciated that infeed means 21 constitutes means for mixing the filler material and molten metal prior to the resulting mixture being injected into die cavity 12.

While the process disclosed above indicated that the filler charge S was placed in shot sleeve 23 prior to the molten metal M, it will be understood, within the broader aspects of this invention, that the molten metal could be placed in the shot sleeve first.

Still further in accordance with this invention, as the mixture of molten metal and particulate filler material enters the die cavity, the molten metal becomes chilled on the walls of the die and thus begins to solidify. However, the preheated grains of the filler material tend to roll over this "skin" of molten metal whereby a substantially pure layer of virgin metal without the sand granules embedded therein is formed at the outer surfaces of the casting. As is shown in FIG. 2, subsequent to solidification of the molten metal, casting C formed in accordance with the method of this invention is removed from the dies of the die casting machine in the conventional manner and flashing and other imperfections on the casting are cleaned up so as to produce a finished part.

Referring to FIGS. 3*a*–3*d*, another embodiment of the process of the present invention is depicted for forming a die cast metal part C′ with particulate filler material being substantially uniformly distributed therein. In FIGS. 3*a*–3*d*, a modified die casting machine is depicted by reference character 1′, and parts having a similar function as heretofore described in regard to machine 1 are indicated by corresponding "primed" reference characters. In FIG. 3*a*, a predetermined charge S′ of preheated particulate filler material (e.g., sand) is deposited in the die cavity 12′ of the closed dies via a sand port P so as to substantially fill the die cavity. A premeasured charge of molten metal M′ is deposited in shot sleeve 23′ of die casting machine 1′. Then, as shown in FIG. 3*b*, the sand port P is blocked off by a suitable core or the like, and the premeasured charge of molten metal is injected under high pressure by means of ram 27′ into the die cavity thereby to flow through the interstitial spaces between the filler granules disposed within the die cavity so as to constitute a metal matrix in which the sand granules are substantially uniformly distributed throughout. In FIG. 3*c*, the dies are opened, and in FIG. 3*d*, the die cast part C′ is removed from the dies in the conventional manner.

It will be appreciated that in accordance with the method of this invention above-described, even though the die cavity 12′ is substantially completely filled with the particulate filler material prior to injecting the molten metal therein, nevertheless a substantial amount of molten metal may be uniformly distributed throughout the die cavity and that in the resulting casting, the molten metal substantially uniformly penetrates and fills all portions of the die cavity.

Still further, it will be understood that, in a variation of the process or method of this invention, a premixed mixture of molten metal and the particulate filler material (e.g., sand) is combined outside of molding apparatus 1 and that a premeasured charge of the filler and molten metal mixture is placed in the shot sleeve of the die casting machine so as to be injected into the die. It has been found, especially when high concentrations of sand are used, that the mixture of molten metal and sand acquires a paste-like consistency thus is somewhat difficult to handle. The process of utilizing premixed molten metal and inert particulate filler material appears to be better adapted for casting operations in which the percentage of filler material is comparatively low, for example, about ninety percent metal, ten percent filler material.

Referring now to FIGS. 4 and 5, photomicrographs of portions of a casting C made in accordance with the method of this invention containing about 21.4 percent sand. FIG. 4 is a ten power (10X) enlargement of a relatively thin web (e.g., about 0.175 inch or 4.5 mm. thick) of casting C. It will be noted that the sand grains are substantially uniformly distributed throughout the web and that a "skin" of substantially virgin metal (i.e., metal with little or no sand included therein) is visible at the outer surfaces of the casting. FIG. 5 is a fifty power (50X) enlargement of the portion as indicated by square B in FIG. 4. It will be noted that the metal matrix completely surrounds the sand granules and no voids or spaces are present.

In view of the above, it will be seen that the several objects and features of this invention are achieved and other advantageous results attained.

As various changes could be made in the above constructions and methods without departing from the scope of this invention, it is intended that all matter contained in the above description or shown in the accompanying drawings shall be interpretted as illustrative and not in a limiting sense.

What is claimed is:

1. A process of die casting a part formed of a metal alloy with an inert, particulate, filler material substantially uniformly distributed throughout the part thereby to decrease the amount of metal alloy required to cast the part, said process being carried out in die casting apparatus having a die cavity and infeed means for forcing molten metal and said filler material into said die cavity under pressure, said process consisting of the steps of:

preheating said filler material to a temperature sufficient to inhibit the premature solidification of the molten metal alloy on the filler material;

placing a predetermined amount of said preheated filler material in the infeed means of said die casting apparatus;

placing a predetermined amount of said molten metal alloy in said infeed means of said die casting apparatus;

forcing said predetermined quantity of molten metal and filler material into said die thereby to substantially uniformly mix said molten metal with said particulate filler material as the molten metal together with said particulate filler material flows into the die cavity of said die casting apparatus so as to form said part; and forming a skin on at least a substantial portion of said part, said skin consisting substantially of metal alloy with substatially none of said filler material visible from the exterior of the part.

2. The process of claim 1 wherein said die cavity has passages therein of a minimum thickness of dimension, and wherein said filler material is selected to have maximum average grain or particle size of approximately one third or less of said minimum thickness dimension.

3. The process of claim 1 wherein the grains of said filler material preferably are at least in part rounded.

4. The process of claim 2 wherein the maximum particle diameter of said inert filler material is about 0.030 inches (0.76 mm.) or less.

5. The process of claim 4 wherein the diameter of said particles of inert filler material ranges between about 0.030 and 0.020 inches (0.76 and 0.50 mm.).

6. The process of claim 1 wherein said inert filler material is sand.

7. The process of claim 6 wherein said sand is preferably river sand having grains with generally rounded surfaces.

8. The process of claim 1 wherein the percentage of said inert filler material in said part ranges up to about sixty percent by volume.

9. The process of claim 1 wherein said metal alloy is an aluminum alloy.

10. The process of claim 1 wherein said inert filler material is preheated to a temperature to within about ±250° F. (139° C.) of the melting point of said alloy.

11. The process of claim 1 wherein said step of forming said skin comprises initially solidifying said molten metal on the surfaces of said die cavity with the particulate filler material initially remaining substantially free of the solidified metal on the die cavity surfaces.

* * * * *